US008967795B2

(12) United States Patent
Sasaki et al.

(10) Patent No.: US 8,967,795 B2
(45) Date of Patent: Mar. 3, 2015

(54) PRINTING APPARATUS

(71) Applicant: Seiko Epson Corporation, Tokyo (JP)

(72) Inventors: Tsuneyuki Sasaki, Matsumoto (JP); Yasuo Naramatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/068,878

(22) Filed: Oct. 31, 2013

(65) Prior Publication Data

US 2014/0125750 A1 May 8, 2014

(30) Foreign Application Priority Data

Nov. 6, 2012 (JP) ..... 2012-244363

(51) Int. Cl.
*B41J 2/01* (2006.01)
*B41J 3/00* (2006.01)
*B41J 11/00* (2006.01)

(52) U.S. Cl.
CPC ..... *B41J 11/0085* (2013.01); *B41J 11/002* (2013.01)
USPC ..... 347/104; 347/4

(58) Field of Classification Search
USPC ..... 347/4, 16, 101, 102, 103, 104, 105
See application file for complete search history.

(56) References Cited

U.S. PATENT DOCUMENTS 7,722,183 B2 * 5/2010 Tanabe ..... 347/104
8,066,283 B2 * 11/2011 Yamada ..... 271/276
8,573,729 B2 * 11/2013 Takamoto ..... 347/16

FOREIGN PATENT DOCUMENTS

| | | |
|---|---|---|
| JP | 06-135071 | 5/1994 |
| JP | 2000-191175 | 7/2000 |
| JP | 2010-260341 | 11/2010 |
| JP | 2011-161833 | 8/2011 |
| JP | 2012-030377 | 2/2012 |

* cited by examiner

*Primary Examiner* — Anh T. N. Vo
(74) *Attorney, Agent, or Firm* — Workman Nydegger

(57) ABSTRACT

A printing apparatus includes a transfer device that transfers a printing medium in a transfer direction, a platen having a support surface that supports the printing medium thereon, a liquid ejection head that ejects an ink onto the printing medium on the support surface, and a heating device that heats the printing medium. The transfer device includes a plurality of driven rollers. The support surface of the platen has a plurality of suction holes that suck the printing medium on the support surface. The support surface includes first portion extending in the transfer direction corresponding to extension lines extending in the transport direction from the portions between each driven roller, and second portions other than the first portions. The first portions are high-density regions where the suction holes are arranged at high density, and the second portions are low-density regions where the suction holes are arranged at low density.

13 Claims, 6 Drawing Sheets

PRINTING APPARATUS

BACKGROUND

1. Technical Field

The present invention relates to a printing apparatus.

2. Related Art

Printing apparatuses such as ink jet recording apparatuses, as disclosed in, for example, JP-A-2010-260341, are conventionally used for printing performed by applying ink on a flexible sheet-type recording or printing medium. The printing apparatus disclosed in JP-A-2010-260341 includes a transfer mechanism that transfers a printing medium, a plate-shaped platen, including a platen cover, that supports the transferred printing medium from the rear side (lower side), a head unit that applies an ink to the printing medium supported by the platen, and a heater that heats the printing medium and the ink deposited on the printing medium together to help the ink adhere to the printing medium. In this printing apparatus, the transfer mechanism includes a plurality of transfer rollers arranged in a direction intersecting the transfer direction of the printing medium, immediately upstream of the platen in the transfer direction.

The platen has a plurality of through holes that are open at the upper surface thereof and arranged in a staggered manner.

Printing media are expanded when heated in a printing apparatus. In the printing apparatus of the above cited patent document, the thermally expanded portion of the printing medium is likely to be bent and trapped between the transfer rollers. Unfortunately, this causes creases in the printing medium, resulting in some problem such as unclear printing or printing failure. Although the through holes of the platen suck the printing medium to flatten it, the bending or creases of the printing medium are not completely suppressed.

SUMMARY

An advantage of some aspects of the invention is that it provides a printing apparatus that can certainly prevent unclear printing caused by thermal expansion of the printing medium.

According to an aspect of the invention, a printing apparatus is provided which includes a transfer device that transfers a flexible printing medium, a platen including a plate having a support surface that supports thereon the printing medium transferred by the transfer device, a head unit including a liquid ejection head that prints on the printing medium by ejecting an ink onto the printing medium on the support surface, and a heating device that heats the printing medium on which the ink has been ejected. The transfer device is disposed immediately upstream of the platen in the transfer direction, and has a plurality of rollers arranged in a direction intersecting the transfer direction. The platen has a plurality of suction holes that are open at the support surface and suck the printing medium on the support surface. The support surface includes first portions extending in the transfer direction corresponding to extension lines extending in the transfer direction from the portions between each of the rollers, and second portions other than the first portions. The first portions are high-density regions where the suction holes are arranged at a high density, and the second portions are low-density regions where the suction holes are arranged at a low density.

A recording medium is likely to be expanded by being heated, and the thermally expanded portion may crease. In the printing apparatus, however, the suction holes of the first portions, which are high-density regions having suction holes with a high density, suck the creases to eliminate. Thus, the thermally expanded portion of the printing medium is prevented from creasing in the high-density regions, and is stretched from the high-density regions and preferentially on the second portions or in the low-density regions. In the printing apparatus, the function of the high-density regions to remove creases and the function of the low-density regions to stretch portions likely to crease produce a synergistic effect of flattening the printing medium on the platen. Consequently, unclear printing resulting from thermal expansion of the printing medium can be certainly prevented.

Preferably, the printing medium will be thermally expanded preferentially on the second portions when heated by the heating device. A recording medium is likely to be expanded by being heated, and the thermally expanded portion may crease. In the printing apparatus, however, the suction holes of the first portions, which are high-density regions having suction holes with a high density, suck the creases to eliminate. Thus, the thermally expanded portion of the printing medium is prevented from creasing in the high-density regions, and is stretched from the high-density regions and preferentially on the second portions or in the low-density regions. In the printing apparatus, the function of the high-density regions to remove creases and the function of the low-density regions to stretch portions likely to crease produce a synergistic effect of flattening the printing medium on the platen. Consequently, unclear printing resulting from thermal expansion of the printing medium can be certainly prevented.

In each first portion, preferably, two or more of the suction holes are aligned in a line in the transfer direction. Such suction holes of the first portion sufficiently suck the thermally expanded printing medium.

Preferably, each second portion has at most one of the suction holes. Consequently, the thermally expanded portion of the printing medium can be certainly stretched in the low-density regions.

Preferably, the first portions have the suction hole located most upstream in the transfer direction. Consequently, creases formed in the thermally expanded portion of the printing medium are preferentially and certainly sucked, and the printing medium is thus prevented from creasing.

Preferably, the transfer device includes a plurality of holders arranged in a direction intersecting the transfer direction. Each holder holds at least two of the rollers. One or more of the first portions lie corresponding to any of the extension lines extending in the transfer direction from the portions between each of the holders, and have suction holes with a higher density than the other first portions. The printing medium on the platen is more likely to crease in the portions corresponding to the extension lines extending in the transfer direction from the portions between each holder. However, the portions of the first portions on which the printing medium is more likely to crease have suction holes with a higher density than the other first portions, and accordingly preferentially suck creases to eliminate the creases certainly.

The printing apparatus may further include a head moving device that transfers the head unit in a direction intersecting the transfer direction. The support surface has a printing region across the first portions and the second portions, over which the head unit prints while being transferred by the head moving device. The suction holes are arranged such that the printing region has suction holes with a higher density than a region of the support surface downstream of the printing region in the transfer direction.

The printing medium is thus certainly stabilized by the suction of the suction holes in the printing region. Consequently, the printing apparatus can perform accurate printing on the printing medium on the printing region. The thermally expanded portion of the printing medium is stretched in the transfer direction from the portion adjacent to the printing region, preferentially on the region of the support surface downstream of the printing region. Consequently, the portion to be printed of the printing medium is flattened, and thus, unclear printing on the printing medium can be certainly prevented.

Preferably, the density of the suction holes is reduced in the transfer direction. The printing medium is thus certainly stabilized by the suction of the suction holes in the printing region. Consequently, the printing apparatus can perform accurate printing on the printing medium on the printing region. The thermally expanded portion of the printing medium is stretched in the transfer direction from the portion adjacent to the printing region, preferentially on the region of the support surface downstream of the printing region. Consequently, the portion to be printed of the printing medium is flattened, and thus, unclear printing on the printing medium can be certainly prevented.

Preferably, the density of the suction holes in each first portion is 1.1 to 10 times as high as the density of the suction holes in each second portion. Consequently, a synergistic effect is markedly produced by eliminating creases in the high-density regions and stretching the portion likely to crease in the low-density region.

Preferably, the suction holes are circular in shape when viewed from above and have an average diameter of 4 mm or less. Such suction holes can adequately suck the printing medium.

The transfer device may further includes a driving roller that rotates the plurality of the rollers and transfers the printing medium while pinching the printing medium with the plurality of rollers therebetween. The combined use of the driving roller and the plurality of rollers ensures the transfer of the printing medium.

Preferably, the heating device includes a heater opposing the support surface with the liquid ejection head therebetween. This structure helps the ink applied on the printing medium to dry, thus certainly drying the ink.

According to another aspect of the invention, a printing apparatus is provided which includes a head unit that ejects an ink onto a printing medium, a platen having a support surface that supports the printing medium thereon, and a plurality of rollers that transfer the printing medium in the transfer direction. The support surface has a plurality of suction holes that suck the printing medium on the support surface. The support surface includes first portions extending in the transfer direction corresponding to extension lines extending in the transfer direction from the portions between each of the rollers, and second portions other than the first portions. Each of the first portions has suction holes with a higher density than each of the second portions.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
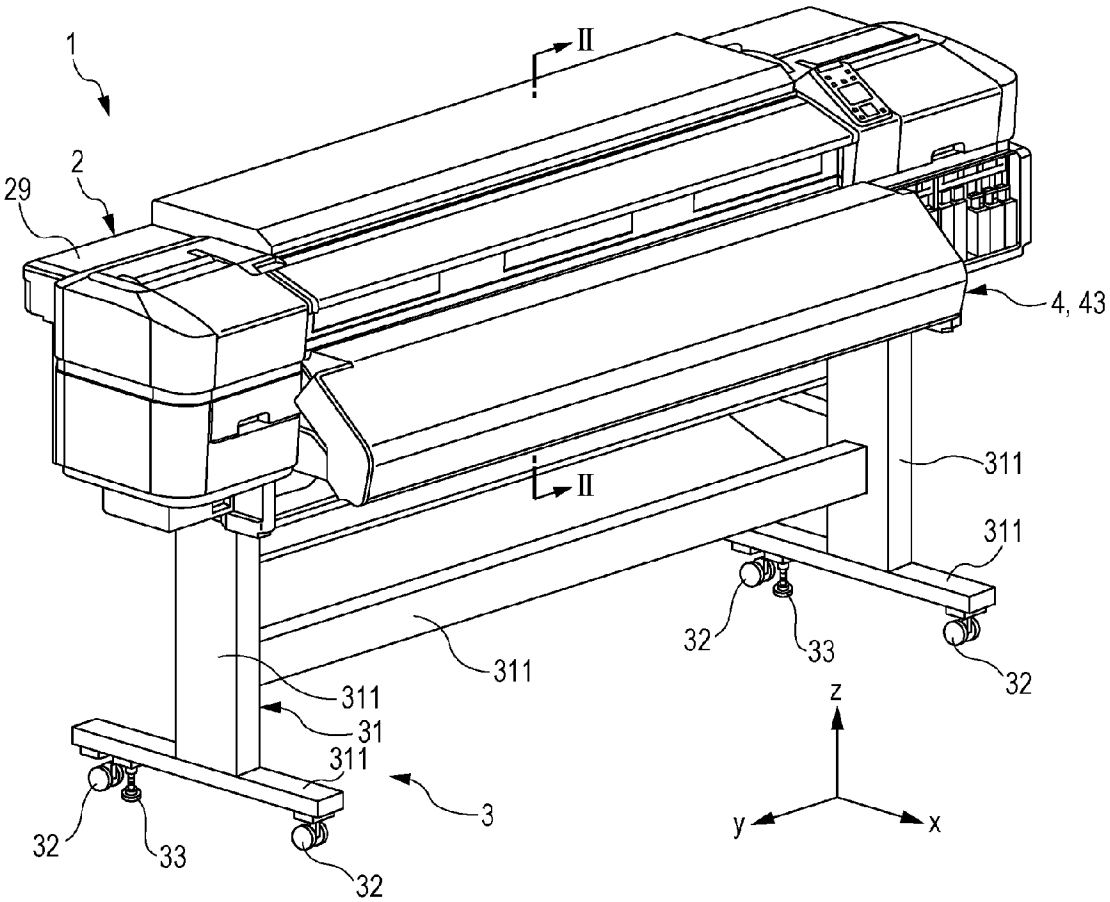
FIG. 1 is a perspective view of a printing apparatus according to an embodiment of the invention.
Figure 2:
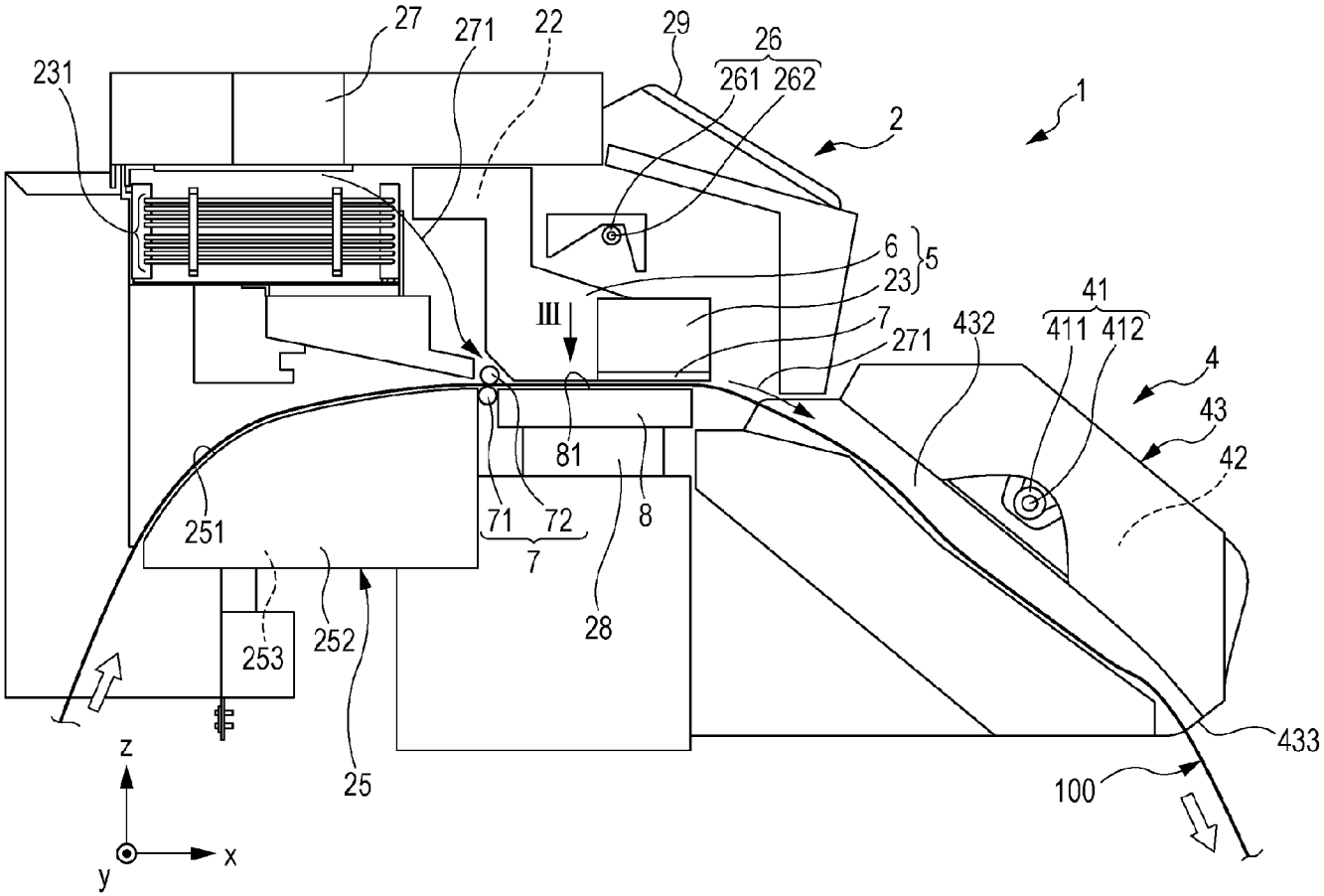
FIG. 2 is a schematic cross sectional view of the printing apparatus taken along line II-II in FIG. 1.
Figure 3:
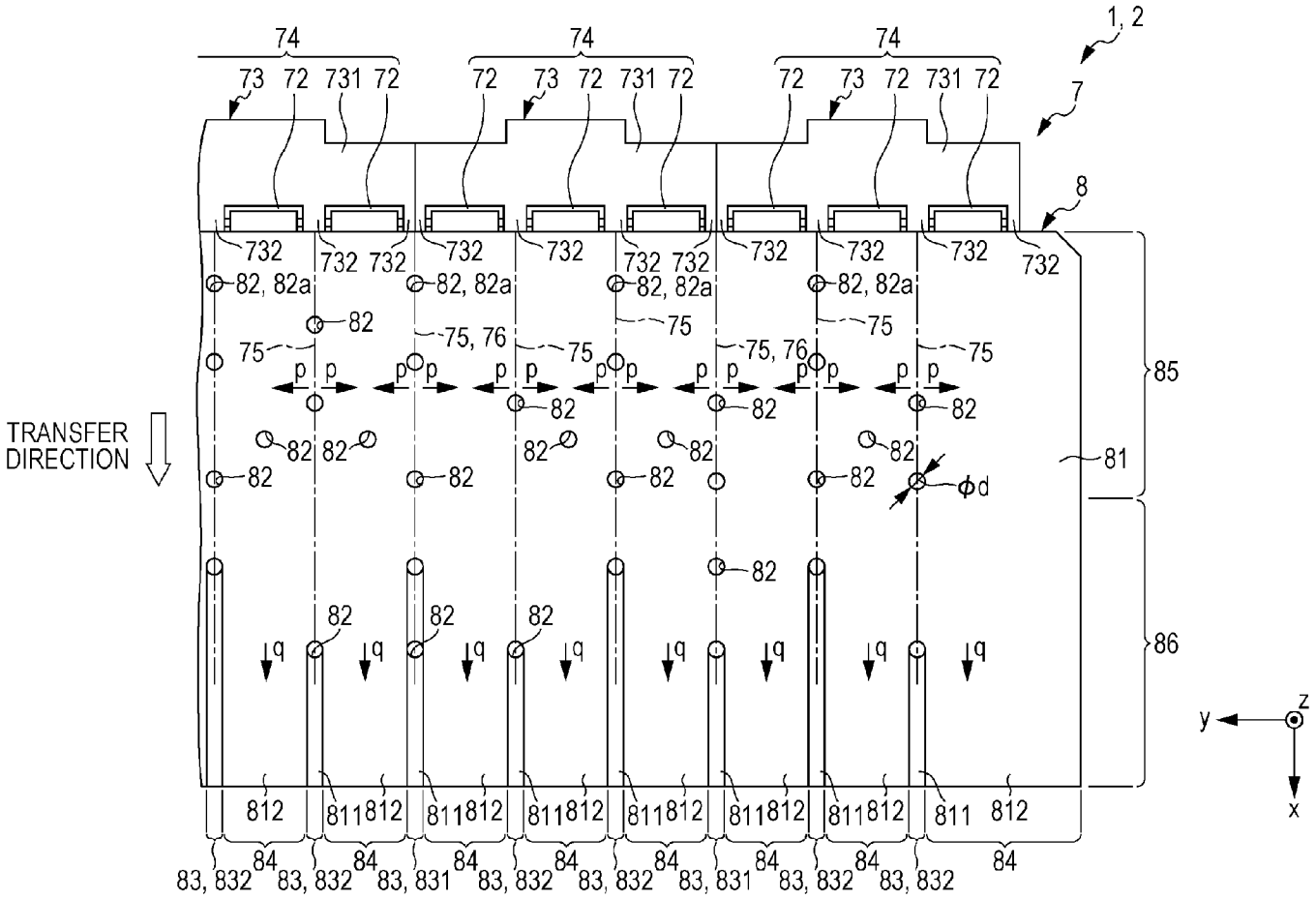
FIG. 3 is a plan view of the printing apparatus viewed in the direction indicated by arrow III in FIG. 2.
Figure 4:
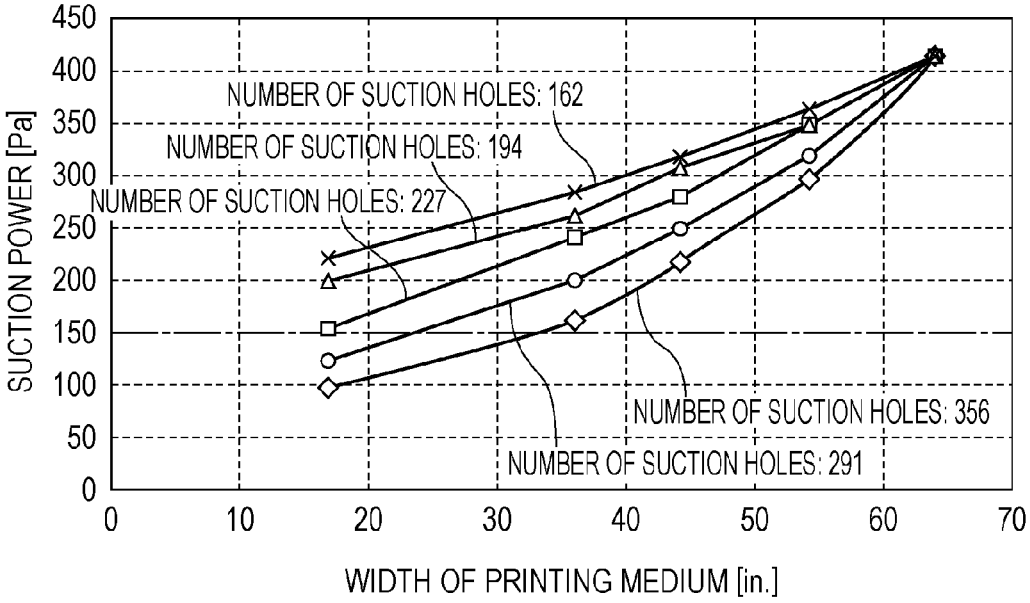
FIG. 4 is a plot showing the relationship between the suction power of the platen shown in FIG. 3 and the number of suction holes in the platen.
Figure 5A:
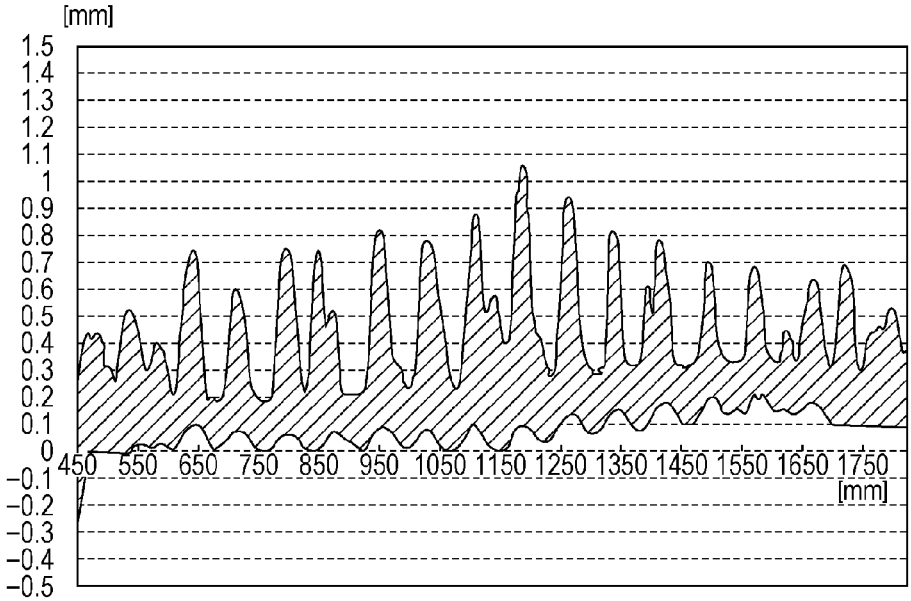
FIGS. 5A and 5B are plots showing the reduction of cockling (creases) in a printed portion of a printing medium printed by the printing apparatus shown in FIG. 1.
Figure 5B:
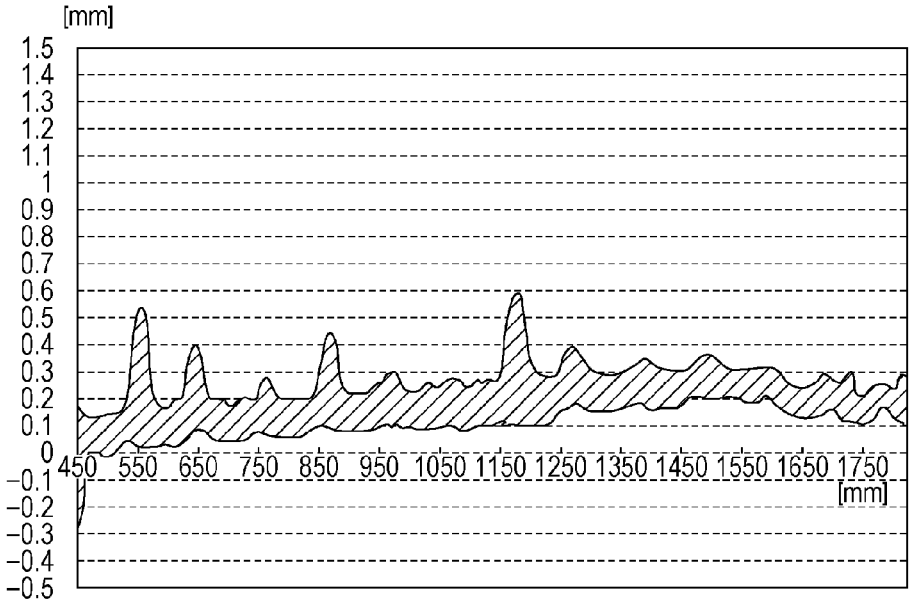
Figure 6A:
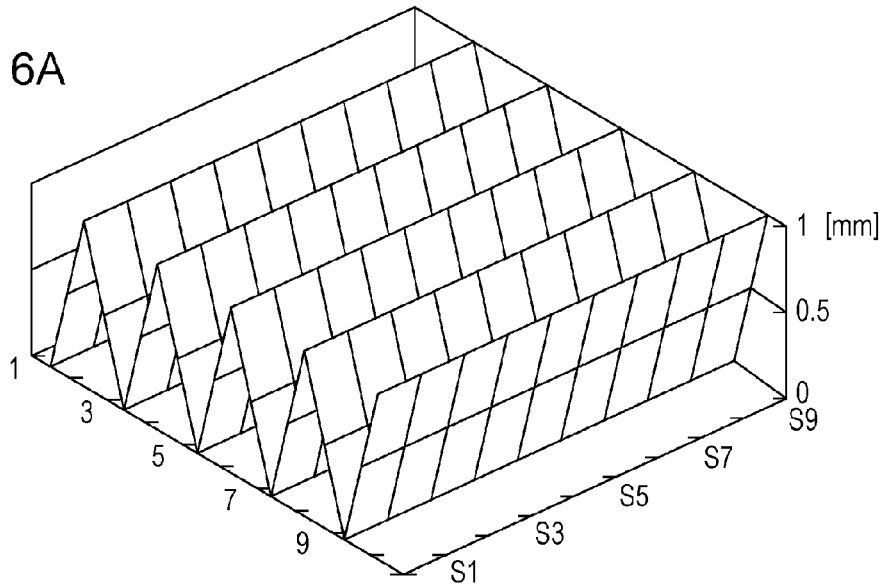
FIGS. 6A and 6B are plots showing the reduction of unevenness (creases) in the entirety of a printing medium printed by the printing apparatus shown in FIG. 1.
Figure 6B:
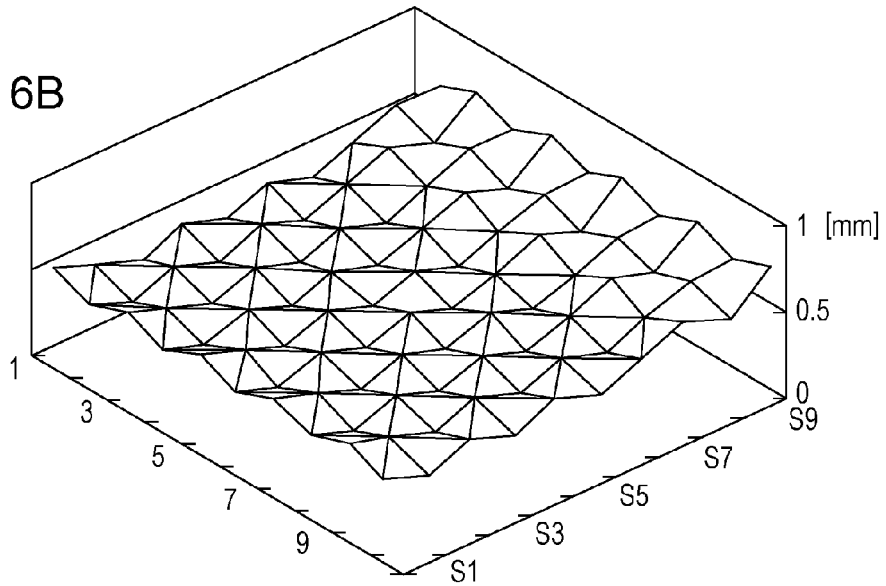

A printing apparatus according to an embodiment of the invention will now be described in detail with reference to the drawings. FIG. 1 is a perspective view of a printing apparatus of an embodiment of the invention. FIG. 2 is a schematic cross sectional view of the printing apparatus taken along line II-II in FIG. 1. FIG. 3 is a plan view viewed from the position of arrow II in the direction indicated by arrow II in FIG. 2. FIG. 4 is a plot showing the relationship between the suction power of the platen shown in FIG. 3 and the number of suction holes in the platen. FIGS. 5A and 5B are plots showing the reduction of cockling (creases) in a printed portion of a printing medium printed by the printing apparatus shown in FIG. 1. FIGS. 6A and 6B are plots showing the reduction of unevenness (creases) in the entirety of a printing medium printed by the printing apparatus shown in FIG. 1. FIGS. 1 to 3 each show three axes orthogonal to each other: x axis, y axis, and z axis for the sake of convenience. The x axis extends in one direction (depth direction of the printing apparatus) on a horizontal plane. The y axis extends in a direction perpendicular to the x axis (longitudinal direction of the printing apparatus) on the horizontal plane. The z axis extends in a vertical direction. In the drawings, each arrow of the x, y and z axes points the positive (+) direction, and the starting point of the arrow is located at the negative (−) side. The upper side in FIGS. 1 and 2 is the upper side of the printing apparatus, and the lower side in the figures is the lower side of the printing apparatus.

As shown in FIG. 1, the printing apparatus 1 includes an apparatus body 2, legs (stands) 3, and a curing unit 4, and applies an ink onto a printing medium 100, thus performing color printing by an ink jet technique. The components of the printing apparatus will be described below.

The ink and the printing medium 100 will first be described. In the present embodiment, "latex ink" is used as ink. A cartridge of an ink set is mounted in the printing apparatus 1. The ink set includes a first ink and a second ink, each having a predetermined composition in either case (A) or case (B) described later.

The first ink contains a coloring material, resin particles, a first moisturizing agent, and an aprotic polar solvent. The second ink contains a coloring material with a higher content than the coloring material content of the first ink, resin particles with a lower content than the resin particle content of the first ink, and a second moisturizing agent, and an aprotic polar solvent. Also, the first and second inks do not substantially contain an alkylpolyol having a boiling point of 280° C. or more. Thus the load of drying operation can be reduced.

The phrase "not substantially contain" used above implies that the ink does not contain, for example, 1.0% by mass or more of a substance. Preferably the content of the substance is less than 0.5%, more preferably less than 0.1% by mass, still more preferably less than 0.01%, and further preferably less than 0.001% by mass, relative to the total mass (100% by mass) of the ink.

The ink set includes the first ink and the second ink, and may further include any other ink. If the ink set includes an ink other than the first and second inks, that ink may contain an alkylpolyol having a boiling point of 280° C. or more.

Possible constituents of the inks of the ink set will now be described. In the following description, the first and second inks and optionally added other inks of the ink set may be collectively referred to as the ink(s).

The constituents and their contents of one of the first and second inks are selected in view of the properties of substances independently of the other ink. The ink set may include a single first ink and a singly second ink, or may include a plurality of first inks or a plurality of second inks. If the ink set includes a plurality of first inks, or if the ink set includes a plurality of second inks, the constituents and their contents of each ink are selected in view of the properties of substances independently of the other inks. When the ink set includes a plurality of first inks, the content of a substance in the first ink refers to the average content of the substance in each first ink. The same applies to a plurality of second inks.

Moisturizing Agent

Each of the first and second inks contains a moisturizing agent. In the description herein, a "first moisturizing agent" refers to the moisturizing agent contained in the first ink, and a "second moisturizing agent" refers to the moisturizing agent contained in the second ink. A set of the first moisturizing agent and the second moisturizing agent is in either case (A) or (B). Cases (A) and (B) will be described below.

First, case (A) will be described. In case (A), the first moisturizing agent is: a solvent (a1) containing 1,2-alkanediol and any other solvent; or a solvent (a2) other than 1,2-alkanediol. The solvent other than 1,2-alkanediol has a boiling point of 200 to 260° C. Hence, the first moisturizing agent contains a solvent other than 1,2-alkanediol having a boiling point in a specific range irrespective of whether or not the first moisturizing agent contains 1,2-alkanediol.

When the first moisturizing agent has a boiling point of 160° C. or more, the printing apparatus can satisfactorily perform intermittent printing. Also, when the first moisturizing agent has a boiling point of 260° C. or less, the first ink does not contains glycerol and accordingly can dry rapidly. Consequently, the resulting printed article exhibits good rub fastness. The solvent other than 1,2-alkanediol having a boiling point of 200 to 260° C. may be, but is not limited to, a glycol ether or 1,α-alkanediol (α: number other than 2).

Examples of the glycol ether include, but are not limited to, diethylene glycol, dipropylene glycol, dibutylene glycol, and other polyalkylene glycols. Exemplary 1,α-alkanediols other than 1,2-alkanediol include, but are not limited to, 1,4-butanediol, 1,5-pentanediol, 1,6-hexanediol, and 1,7-heptanediol. Polyalkylene glycols include alkylene glycol monoalkyl ethers. Exemplary alkylene glycol monoalkyl ethers include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol dimethyl ether, diethylene glycol diethyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, dipropylene glycol monomethyl ether, and dipropylene glycol monoethyl ether. Polyalkylene glycols include alkylene glycol dialkyl ethers. Exemplary alkylene glycol dialkyl ethers include ethylene glycol dimethyl ether, ethylene glycol diethyl ether, ethylene glycol dibutyl ether, diethylene glycol dimethyl ether, diethylene glycol diethyl ether, diethylene glycol dibutyl ether, triethylene glycol dimethyl ether, triethylene glycol diethyl ether, triethylene glycol dibutyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether. Poly alkylene glycols have superior moisture-retaining properties and are accordingly advantageous. Thus, the solvent other than 1,2-alkanediol is preferably selected from the glycol ethers and 1,α-alkanediols (α: number other than 2). These moisturizing agents can impart appropriate moisture-retaining properties.

When the first moisturizing agent is a solvent (a1) containing 1,2-alkanediol and any other solvent, the mass ratio of the total content of first moisturizing agents in the first ink to the content of aprotic polar solvent described later, that is, first moisturizing agent content/aprotic polar solvent content, is preferably 0.6 to 2.6. Such a mass ratio leads to good adhesion.

In case (A), the boiling point of the first moisturizing agent is higher than that of the second moisturizing agent. If the first moisturizing agent contains two or more solvents, the boiling point of the first moisturizing agent refers to the average of the boiling points of the solvents. The same applies to the boiling point of the second moisturizing agent.

When the above conditions are satisfied, the second moisturizing agent is also: a solvent (a3) containing 1,2-alkanediol and any other solvent; or a solvent (a4) other than 1,2-alkanediol. In the second moisturizing agent, the solvent other than 1,2-alkanediol preferably has a boiling point of 160 to 240° C. Hence, the second moisturizing agent contains a solvent other than 1,2-alkanediol having a boiling point in a specific range irrespective of whether or not the second moisturizing agent contains 1,2-alkanediol.

When the second moisturizing agent has a boiling point of 160° C. or more, the printing apparatus can satisfactorily perform intermittent printing. In addition, when the second moisturizing agent has a boiling point of 240° C. or less, the load of drying the ink can be reduced effectively. The solvent of the second moisturizing agent other than 1,2-alkanediol is not limited as long as the boiling point is in the range of 160 to 240° C. and lower than the boiling point of the first moisturizing agent. For example, glycol ethers are advantageously used from the viewpoint of easy drying.

Case (B) will now be described. In case (B), the first and second moisturizing agents are each dipropylene glycol. In addition, the dipropylene glycol content in the first ink is higher than the dipropylene glycol content in the second ink. The dipropylene glycol content in the first ink is preferably in the range of 3% to 30% by mass, more preferably 5% to 15% by mass, relative to the total mass (100% by mass) of the first ink. The dipropylene glycol content in the second ink is preferably in the range of 3% to 30% by mass, more preferably 5% to 15% by mass. When the dipropylene glycol contents in the first and second inks are in the above ranges, the load of drying the ink can be reduced effectively. When the ink set further includes an ink other than the first and second inks, the ink other than the first and second inks may contain any of the above-described moisturizing agents.

Coloring Material

Each of the first ink and the second ink contains a coloring material. The color material is selected from among pigments and dyes.

1. Pigment

Pigments are not only insoluble or difficult to dissolve in water, but are also not easily discolored by light or gases. Accordingly, printed articles prepared by printing with an ink containing a pigment are resistant to water, gases, weather and light, and can be stably stored.

The pigment may be an inorganic pigment or an organic pigment. Preferably, the pigment exhibits high color developability, and has such a low specific gravity that the pigment particles do not easily settle when dispersed. Exemplary inorganic pigments include, but are not limited to, carbon black, iron oxide, and titanium oxide.

Examples of the carbon black include, but are not limited to, furnace black, lamp black, acetylene black, and channel black (C. I. Pigment 7). Commercially available carbon blacks include Nos. 2300 and 900, MCF 88, No. 20B, No. 33, No. 40, No. 45, No. 52, MA 7, MA 8, MA 100, and No. 2200B (each produced by Mitsubishi Chemical); Color Black series FW1, FW2, FW2V, FW18, FW200, 5150, 5160 and 5170, Pritex series 35, U, V and 140U, and Special Black series 6, 5, 4A, 4 and 250 (each produced by Degussa AG); Conductex SC, and Raven series 1255, 5750, 5250, 5000, 3500, 1255 and 700 (each produced by Columbian Carbon); Regal series 400R, 330R and 660R, Mogul L, Monarch series 700, 800, 880, 900, 1000, 1100, 1300 and 1400, and Elftex 12 (each produced by Cabot).

Examples of the organic pigment that can be used in the first and second inks include, but are not limited to, quinacridone pigments, quinacridonequinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perinone pigments, quinophthalone pigments, anthraquinone pigments, thioindigo pigments, benzimidazolone pigments, isoindolinone pigments, azomethine pigments, and azo pigments. More specific examples of the organic pigment are as below.

Pigments that can be used in a cyan ink include C. I. Pigment Blues 1, 2, 3, 15, 15:1, 15:2, 15:3, 15:4, 15:6, 15:34, 16, 18, 22, 60, 65 and 66, and C. I. Vat Blues 4 and 60.

Pigments that can be used in a magenta ink include C. I. Pigment Reds 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254 and 264, and C. I. Pigment Violets 19, 23, 32, 33, 36, 38, 43 and 50.

Pigments that can be used in a yellow ink include C. I. Pigment Yellows 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185 and 213.

For other color inks, such as a green ink and an orange ink, known pigments can be used. A pigment may be used singly, or two or more pigments may be used in combination.

2. Dye

The coloring material may be a dye. Examples of the dye include, but are not limited to, acid dyes, direct dyes, reactive dyes, and basic dyes. Exemplary dyes include C. I. Acid Yellows 17, 23, 42, 44, 79 and 142, C. I. Acid Reds 52, 80, 82, 249, 254 and 289, C. I. Acid Blues 9, 45 and 249, C. I. Acid Blacks 1, 2, 24 and 94, C. I. Food Blacks 1 and 2, C. I. Direct Yellows 1, 12, 24, 33, 50, 55, 58, 86, 132, 142, 144 and 173, C. I. Direct Reds 1, 4, 9, 80, 81, 225 and 227, C. I. Direct Blues 1, 2, 15, 71, 86, 87, 98, 165, 199 and 202, C. I. Direct Blacks 19, 38, 51, 71, 154, 168, 171 and 195, and C. I. Reactive Reds 14, 32, 55, 79 and 249, and C. I. Reactive Blacks 3, 4 and 35.

A dye may be used singly, or two or more dyes may be used in combination. The coloring material content in the second ink is higher than the coloring material content in the first ink. Accordingly, in view of the density of the coloring material, the first ink and the second ink may be called a light ink and a deep ink respectively. The coloring material content in the second ink is preferably 1% to 7% by mass relative to the total mass (100% by mass) of the second ink. The coloring material content in the first ink is preferably 0.1% to 2% by mass relative to the total mass (100% by mass) of the first ink. When the ink set further includes an ink other than the first and second inks, the ink other than the first and second inks may contain any of the above-cited coloring materials.

Resin Particles

Each of the first ink and the second ink contains resin particles. By adding resin particles to the first and second inks, the resulting printed article can exhibit good rub fastness. The content of the resin particles in the second ink is lower than the content of the resin particles in the first ink. Thus the inks of the ink set can have the same viscosity. The contents of the resin particles in the first ink and the second ink will be described later. The material of the resin particles may be, but is not limited to, a resin binder, or a wax such as paraffin wax or polyolefin wax.

1. Binder Resin

The binder resin used as the resin particles will form a resin coating when the printing medium 100 is heated for ink jet printing. The resin coating helps the ink adherer to the printing medium 100, thus enhancing the rub fastness of the printed article. Accordingly, the binder resin is preferably thermoplastic. If an ink containing a binder resin is used on an ink-non-absorbent or ink-low-absorbent printing medium 100, the resulting printed article can exhibit good rub fastness effectively.

The binder resin is present in a state of emulsion in the ink. The use of the binder resin in an emulsion state in the ink makes it easy to control the viscosity of the ink in a proper range, and enhances the storage stability and ejection stability of the ink. The term "ejection stability" used herein refers to a characteristic that ink droplets can be constantly ejected stably without clogging nozzles.

Examples of the binder resin include, but are not limited to, homopolymers and copolymers of (meth)acrylic acid, (meth) acrylic acid ester, acrylonitrile, cyanoacrylate, acrylamide, olefin, styrene, urethane, vinyl acetate, vinyl chloride, vinyl alcohol, vinyl ether, vinyl pyrrolidone, vinyl pyridine, vinyl carbazole, vinyl imidazole and vinylidene chloride, fluororesins, and natural resins. Preferably, the binder resin contains at least either a (meth)acrylic resin or a styrene-(meth) acrylic acid copolymer, more preferably either an acrylic resin or a styrene-acrylic acid copolymer, and still more preferably a styrene-acrylic acid copolymer. If a copolymer is used, the copolymer may be a random copolymer, a block copolymer, an alternating copolymer, or a graft copolymer. In the description herein, "(meth)acrylate" refers to at least either an acrylate or the corresponding methacrylate, and "(meth)acrylic" compound refers to at least either an acrylic compound or the corresponding methacrylic compound.

The binder resin may be prepared using known materials by a known method, or a commercially available binder resin may be used. Commercially available binder resins include Micro Gel E-1002 and Micro Gel E-5002 (each produced by Nippon Paint Co., Ltd.), VONCOAT 4001 and VONCOAT 5454 (each produced by DIC), SAE 1014 (produced by Zeon Corporation), Saivinol SK-200 (produced by Saiden Chemical Industry Co., Ltd.), and JONCRYL 7100, JONCRYL 390, JONCRYL 711, JONCRYL 511, JONCRYL 7001, JON- CRYL 632, JONCRYL 741, JONCRYL 450, JONCRYL 840, JONCRYL 74J, JONCRYL HRC-1645J, JONCRYL 734, JONCRYL 852, JONCRYL 7600, JONCRYL 775, JONCRYL 537J, JONCRYL 1535, JONCRYL PDX-7630A, JONCRYL 352J, JONCRYL 352D, JONCRYL PDX-7145, JONCRYL 538J, JONCRYL 7640, JONCRYL 7641, JONCRYL 631, JONCRYL 790, JONCRYL 780 and JONCRYL 7610 (each produced by BASF).

If the binder resin is prepared by a known method, the method is not particularly limited and, for example, the following methods may be applied, in combination if necessary. A polymerization catalyst (polymerization initiator) and a dispersant may be mixed to a monomer forming a desired resin to polymerize (emulsion polymerization). A solution of a resin having a hydrophilic portion in a water-soluble organic solvent may be mixed with water and then the water-soluble organic solvent is removed by vaporization. A solution of a resin in a water-insoluble organic solvent and a dispersant may be mixed in water.

A dispersant may be used for dispersing the binder resin to prepare an emulsion of the binder resin. Examples of the dispersant include, but are not limited to, anionic surfactants, such as sodium dodecylbenzenesulfonate, sodium lauryl phosphate and polyoxyethylene alkyl ether ammonium sulfate; and nonionic surfactants, such as polyoxyethylene alkyl ether, polyoxyethylene alkyl ester, polyoxyethylene sorbitan fatty acid ester and polyoxyethylene alkylphenyl ether. These dispersants may be used singly or in combination.

The average particle size of the binder resin is preferably in the range of 5 to 400 nm, more preferably 20 to 300 nm, from the viewpoint of enhancing the storage stability and ejection stability of the ink. The average particle size mentioned herein is a value measured by dynamic light scattering.

The content of the binder resin (in terms of solid) in each ink is preferably in the range of 0.5% to 5% by mass, more preferably 0.5% to 1.5% by mass, relative to the total mass (100% by mass) of the ink. Such a binder resin content leads to enhanced rub fastness.

2. Paraffin Wax

Paraffin wax contained in the ink imparts a slip property to the resulting printed article and thus enhances the rub fastness of the printed article. In addition, since paraffin wax is repellent to water, the resulting printed article can exhibit high water fastness.

The term "paraffin wax" used herein refers to a wax prepared from petroleum, and is a mixture of hydrocarbons having weight average molecular weights of about 300 to 500, containing mainly a linear paraffin (normal hydrocarbon) having a carbon number of about 20 to 30, and a small amount of isoparaffin.

The paraffin wax is present in a state of emulsion in the ink. Such a paraffin wax makes it easy to adjust the ink to a viscosity suitable for ink jet printing, and helps enhance the storage stability and ejection stability of the ink.

The melting point of the paraffin wax is preferably 110° C. or less from the view point of forming a harder coating for the resulting printed article, and further enhancing the rub fastness of the printed article. On the other hand, the lower limit of the melting point of the paraffin wax is preferably 60° C. or more from the viewpoint of preventing the printed article from having a sticky surface by being dried. Still more preferably, the melting point of the paraffin wax is 70 to 95° C. from the viewpoint of further enhancing the ejection stability of the ink.

The average particle size of the paraffin wax is preferably in the range of 5 to 400 nm, more preferably 50 to 200 nm, from the viewpoint of making the paraffin wax a stable emulsion and further enhancing the storage stability and ejection stability of the ink. A commercially available paraffin wax may be used as it is. The commercially available paraffin wax may be, but is not limited to, AQUACER 537 or AQUACER 539 (each produced by BYK). The paraffin wax content (in terms of solid) in each ink is preferably in the range of 0% to 1.5% by mass, more preferably 0.25% to 0.75% by mass, relative to the total mass (100% by mass) of the ink.

3. Polyolefin Wax

By adding polyolefin wax to the ink, the rub fastness of the printed article can be further enhanced. The polyolefin wax may be, but is not limited to, polyethylene wax or polypropylene wax. Preferably, a polyethylene wax is used.

A polyethylene wax can be produced by polymerizing ethylene, or by thermally decomposing ordinary polyethylene into low-molecular weight components. The resulting polyethylene wax is oxidized so that a carboxy group or a hydroxy group is added, and is then emulsified with a surfactant to yield a stable aqueous emulsion of the polyethylene wax.

A commercially available polyolefin wax may be used as it is. The commercially available polyolefin wax may be, but is not limited to, NOPCOTE PEM 17 (produced by Sannopco Limited), CHEMIPEARL W4005 (produced by Mitsui Chemicals), or AQUACER 515 or AQUACER 593 (each produced by BYK). The average particle size of the polyolefin wax is preferably in the range of 5 to 400 nm, more preferably 50 to 200 nm, from the viewpoint of further enhancing the storage stability and ejection stability of the ink.

The polyolefin wax content (in terms of solid) in each ink is preferably in the range of 0% to 1.5% by mass, more preferably 0.25% to 0.75% by mass, relative to the total mass (100% by mass) of the ink. In order to further enhance the rub fastness of the printed article, the resin particles contain at least either polyolefin wax or paraffin wax.

The resin particles may further contain other wax. The wax other than polyolefin wax and paraffin wax has the function of imparting a slip property to the resulting printed article to enhance the rub fastness of the printed article. Such wax is preferably present in an emulsion state in the ink. The emulsions of waxes in the ink make it easy to adjust the ink to a viscosity suitable for ink jet printing, and help enhance the storage stability and ejection stability of the ink. When the ink set further includes an ink other than the first and second inks, the ink other than the first and second inks may contain any of the above-cited resin particles.

Aprotic Polar Solvent

Each of the first ink and the second ink contains an aprotic polar solvent. Since the aprotic polar solvent can dissolve the resin particles in the ink, the ink can be prevented from clogging nozzles during ink jet printing.

The aprotic polar solvents contained in the first and second inks may be the same. Exemplary aprotic polar solvents include, but are not limited to, pyrrolidones, lactones, sulfoxides, imidazolidinones, sulfolanes, urea derivatives, dialkylamides, cyclic ethers, and amide ethers. These may be used singly or in combination.

Exemplary pyrrolidones include 2-pyrrolidone, N-methyl-2-pyrrolidone, and an N-ethyl-2-pyrrolidone. Exemplary lactones include γ-butyrolactone, γ-valerolactone, and ε-caprolactone. Exemplary sulfoxides include dimethyl sulfoxide and tetramethylene sulfoxide. An example of the imidazolidinone may be 1,3-dimethyl-2-imidazolidinone. Exemplary sulfolanes include sulfolane and dimethyl sulfolane. Exemplary urea derivatives include dimethylurea and 1,1,3,3-tetramethylurea. Exemplary dialkylamidoes include dimethylformamide and dimethylacetamide. Exemplary cyclic ethers include 1,4-dioxane and tetrahydrofuran. An example of the amide ethers may be the compound expressed by the following general formula (1):

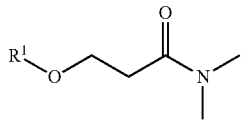

(1)

In general formula (1), R1 is preferably an alkyl group having a carbon number of 1 to 4. The alkyl group having a carbon number of 1 to 4 may be linear or branched, and examples of the alkyl croup include methyl, ethyl, n-propyl, isopropyl, n-butyl, isobutyl, sec-butyl, and tert-butyl. The solvent expressed by general formula (1) in which R1 represents an alkyl group having a carbon number of 1 to 4 can impart proper pseudoplasticity to the ink. Consequently, the ink can be stably ejected. Also, such a solvent can dissolve resin and is thus advantageous.

The HLB (Hydrophile-Lipophile Balance) value of the solvent expressed by general formula (1) is preferably in the range of 10.5 to 20.0, more preferably 12.0 to 18.5. A solvent expressed by general formula (1) having an HLB value in these ranges is more advantageous in imparting proper pseudoplasticity to the ink and in interaction with the resin component.

The HLB value of the solvent expressed by general formula (1) refers to a value obtained from the following equation using the ratio of the inorganic value (I) of the solvent to the organic value (O) of the solvent according to an organic conceptual diagram, and may be simply referred to as I/O value.

$$\text{HLB value}=(\text{inorganic value}(I)/\text{organic value}(O))\times 10$$

More specifically, the I/O value can be calculated according to any of the books: A. Fujita, Systematic Organic Qualitative Analysis for Mixtures (in Japanese), Kazama Shobo, (1974); H. N. Kuroki, Theoretical Chemistry for Dyeing (in Japanese), Maki Shoten, (1966); and H. Inoue, Method for Separating Organic Compounds (in Japanese), Shokabo Publishing, (1990). Preferably, the aprotic polar solvent is selected from among pyrrolidones, lactones, sulfoxides and amide ethers from the viewpoint of enhancing the fixity of the ink to the printing medium 100.

The aprotic polar solvent preferably has a boiling point in the range of 200 to 260° C. Such an aprotic polar solvent may be, but is not limited to, 2-pyrrolidinone. The aprotic polar solvents in the first and second inks may be the same or different, and may be a single solvent or a mixture of two or more solvents.

The aprotic polar solvent content in each of the first and second inks is preferably in the range of 3% to 30% by mass, more preferably 8% to 20% by mass, relative to the total mass (100% by mass) of the ink. When the ink set further includes an ink other than the first and second inks, the ink other than the first and second inks may contain any of the above-cited aprotic polar solvents.

Surfactant

Each ink of the ink set may contain a surfactant. The surfactant may be, but is not limited to, a nonionic surfactant. Nonionic surfactants help the ink spread uniformly on the printing medium 100. Accordingly, when an ink containing a nonionic surfactant is used for ink jet printing, high-definition images can be formed without bleeding. Examples of the nonionic surfactant include, but are not limited to, acetylene glycol-based surfactants, silicone surfactants, polyoxyethylene alkyl ethers, polyoxypropylene alkyl ethers, polycyclic phenyl ethers, sorbitan derivatives, and fluorochemical surfactants. These surfactants may be used singly or in combination. The surfactant content in each ink can be in the range of 1.5% by mass or less relative to the total mass (100% by mass) of the ink.

Water

Each ink of the ink set may contain water. Particularly when the ink is aqueous, the water acts as the main medium of the ink and will be evaporated by heating the printing medium 100.

The water may be pure water or ultra-pure water from which ionic impurities have been removed as much as possible. Examples of such water include ion exchanged water, ultrafiltered water, reverse osmosis water, and distilled water. Sterile water prepared by, for example, UV irradiation or addition of hydrogen peroxide can prevent, for a long time, the occurrence of mold or bacteria in the ink.

Other Constituents

Each ink of the ink set may further contain an organic solvent other than the above described solvents, a pH adjuster, a preservative and a fungicide, a rust preventive, a chelating agent, and other additives. The printing medium 100 to which the ink will be deposited is flexible, and a roll of the printing medium 100 is loaded in the printing apparatus 1. The printing medium 100 may be an ink-absorbent medium, or an ink-non-absorbent or ink-low-absorbent medium.

The ink-absorbent printing medium 100 may be, but is not limited to, ink jet printing paper, such as plain paper, high-quality paper, or glossy paper. The ink-low-absorbent printing medium 100 may be book printing paper, such as art paper, coated paper, or matte paper. The ink-non-absorbent printing medium 100 may be, but is not limited to, a plastic film not surface-treated for ink jet printing (not having an ink-absorbing layer), or a paper sheet or any other material coated or bonded with a plastic film. The plastic film may be made of, but not limited to, polyvinyl chloride, polyethylene terephthalate, polycarbonate, polystyrene, polyurethane, polyethylene, or polypropylene.

The printing apparatus 1 will now be described. The printing apparatus 1 of an embodiment of the invention includes an apparatus body 2, legs 3, and a curing unit 4, as described above with reference to FIG. 1. As shown in FIG. 2, the apparatus body 2 includes a transfer device 7, a head unit (head assembly) 5, a head moving device 22, a platen 8, a preheater 25, a drying heater (heating unit) 26, a blowing fan 27, a suction fan 28, and a housing 29. The housing 29 is a case containing together the transfer device 7, the head unit 5, the head moving device 22, the platen 8, the preheater 25, the drying heater 26, the blowing fan 27, and the suction fan 28. The housing 29 (apparatus body 2) has a shape long in the y direction.

The transfer device 7 transfers the printing medium 100. The direction in which the printing medium 100 is transferred is referred to as the transfer direction. The transfer device 7 includes a single driving roller 71, a plurality of driven rollers 72 rotated by the rotation of the driving roller 71, and one or more holders 73 each holding three of the driven rollers 72.

The driving roller 71 is connected to a motor with a deceleration mechanisms such as a gear therebetween The driving roller 71 is rotated by the operation of the motor. The driven rollers 72 oppose the driving roller 71 above the driving roller 71. The driving roller 71 has such a length as to oppose all the driven rollers 72 at one time.

As shown in FIG. 3, the driven rollers 72 are aligned in a direction intersecting the transfer direction, that is, in the y direction. The printing medium 100 pinched between the driving roller 71 and the driven rollers 72 can be certainly transferred by the rotation of the rollers.

The holders 73 are aligned in the y direction as with the driven rollers 72. Each holder 73 holds three driven rollers 72. In the present embodiment, one holder 73 and three driven rollers 72 constitute a roller unit 74.

The holder 73 has a body 731 in the form of a block and four ribs 732 projecting in one direction from the body 731. The body 731 is fixed to the housing 29. The four ribs 732 are arranged at regular intervals in the y direction. The driven rollers 72 are disposed, one each, between the ribs 732 so as to be held for rotation. Although the number of driven rollers 72 that the holder 73 holds is three in the embodiment shown in FIG. 3, it may be two or four or more without being limited.

The driving roller 71, the driven rollers 72 and the holders may be made of any material without particular limitation. For example, a metal or a resin may be used. The preheater 25 heats the printing medium 100 before the printing medium 100 is printed. The preheater 25 includes a preheater housing 252 having a contact surface 251 in contact with the rear side of the printing medium 100, and a heating element 253 in the housing 252.

The contact surface 251 is curved into an arch shape. The printing medium 100 comes into contact with the contact surface 251 in the course of transfer by the transfer device 7. At this time, heat from the heating element 253 is transmitted to the printing medium 100 through the contact surface 251. Thus, the printing medium 100 is heated. Preferably, the preheater heats the printing medium 100 so that the surface temperature of the printing medium 100 becomes 5° C. or more higher than the surface temperature of the printing medium 100 on the platen 8.

Preferably, the curvature of the contact surface 251 is gradually reduced in the transfer direction, that is, in the positive x direction. The preheater housing 252 may be made of, but is not limited to, aluminum or an aluminum alloy, or stainless steel. The heating element 253, which generates heat by receiving electric power, is made of a metal having a relatively high electric resistance, such as nichrome wire. The platen 8 is disposed downstream of the preheater 25 in the transfer direction. The platen 8 keeps the printing medium 100 as flat as possible when an ink is applied to the printing medium 100.

As shown in FIG. 3, the platen 8 includes a rectangular plate in a position long in the y direction when viewed from above. The rectangular plate of the platen 8 has an upper flat surface serving as a support surface 81 that supports the printing medium 100 transferred by the operation of the transfer device 7, from the rear side (lower side) of the printing medium 100, that is, the side opposing the upper surface of the platen 8. The support surface 81 keeps the printing medium 100 as flat as possible during printing.

The support surface 81 has a plurality of suction holes 82 that suck the printing medium 100 supported on the support surface 81. Each suction hole 82 may be, for example, circular, oval (ellipsoidal), or rectangular in shape when viewed from above, and is preferably circular.

Under the platen 8, a suction fan 28 is disposed. The printing medium 100 on the platen 8 is sucked through the suction holes 82 by the operation, or rotation, of the suction fan 28. Thus the position of the printing medium 100 is stabilized so that the ink can be accurately applied onto desired points on the printing medium 100.

The suction fan 28 can be selected from among various type of fan without particular limitation, and, for example, may be a multiblade fan such as a sirocco fan. The platen 8 may be made of the same material as the housing 252.

As shown in FIG. 2, the head unit 5 is an assembly including a liquid ejection head 23 and a carriage 6. The liquid ejection head 23 is disposed over the platen 8. The liquid ejection head 23 has a plurality of nozzle apertures (not shown) that are open downward. The liquid ejection head 23 ejects droplets of an ink through the nozzles onto the printing medium 100 supported on the support surface 81 of the platen 8. Thus, the printing medium 100 is printed.

Each of the nozzle apertures communicates with the ink set (cartridge) through a tube 231. Thus, the inks are supplied to the nozzle apertures. The carriage 6 holds the liquid ejection head 23. The carriage 6 is connected to the head moving device 22.

The head moving device 22 reciprocally transfers the head unit 5 in the y direction, or a direction intersecting (perpendicular to) the transfer direction of the printing medium 100. The head moving device 22 includes, for example, a motor, a ball screw connected to the motor, and a linear guide disposed parallel to the boll screw. While the head moving device 22 reciprocally transfers the liquid ejection head 23, the liquid ejection head 23 ejects the inks onto the printing medium 100 being transferred in the positive x direction, thus printing the printing medium 100 with the inks.

The drying heater 26 opposes the support surface 81 of the platen 8 with the head unit 5 (liquid ejection head 23) therebetween. The drying heater 26 heats the printing medium 100 and the ink deposited on the printing medium 100. More specifically, while ink is ejection onto the printing medium 100, the drying heater 26 irradiates the ink to infrared radiation so as to help the ink dry.

The drying heater 26 includes a tube 261 running in the y direction, and a heating element 262 passing through the tube 261. The tube 261 is made of a metal, and is preferably made of iron. The length, in the y direction, of the tube 261 is preferably larger than the width of the printing medium 100 in the y direction so that the entirety of the ink on the printing medium 100 transferring under the tube 261 (drying heater 26) can be irradiated with infrared radiation.

The heating element 262, which generates heat by receiving electric power, is made of, for example, an electrically-heated wire such as nichrome wire. The tube 261 is heated by heat generated by the heating element 262, thus emitting infrared radiation. Thus, the water in the ink can be certainly removed, so that the ink is dried. The heating temperature at which the tube 261 is heated is for example in the range of 400 to 800° C., and is preferably 700° C. or less.

The ink on the printing medium 100 can be dried by heating the rear side of the printing medium 100, using a platen having a structure capable of functioning as a heating plate. However, this method may cause the ink to form a coating due to the nature of the ink, and the coating is likely to inhibit the evaporation of water in the ink. It is therefore preferable that the ink be heated from a position over the printing medium 100.

The blowing fan 27 is disposed upstream in the transfer direction at an upper portion of the apparatus body 2. The blowing fan 27 sends air 271 along the transfer of the printing medium 100. The blowing air 271 purges the vapor generated by heating the ink from the apparatus body 2. Thus, the condensation of the liquid ejection head 23 can be prevented. As with the suction fan 28, the blowing fan 27 can be selected from among various type of fan without particular limitation, and, for example, may be a multiblade fan.

The apparatus body 2 is supported upward by legs 3, as shown in FIG. 1. The legs 3 include a frame 31, four casters 32, and two adjuster feet (fixtures) 33. The frame 31 is an assembly including a plurality of bar members 311 that are appropriately connected and fixed to each other.

The casters 32 are fixed with spaces therebetween to the bottom of the frame 31. The printing apparatus 1 thus can be transferred. The adjuster feet 33 are also fixed to the bottom of the frame 31. The adjuster feet 33 are each disposed near either of the two of the four casters 32 located at the negative side of the x direction. The adjuster feet 33 can stop the printing apparatus 1 by being brought into contact with the floor after transfer of the printing apparatus 1.

The curing unit 4 is disposed downstream of the apparatus body 2 in the transfer direction. As shown in FIG. 2, the curing unit 4 includes a curing heater 41, a cooling fan 42, and a housing 43. The housing 43 is a case containing together the curing heater 41 and the cooling fan 42. The housing 43 of the curing unit 4 has a shape long in the y direction, having a length smaller than the housing 29 of the apparatus body 2.

The housing 43 of the curing unit 4 is provided with a passage 432 through which the printing medium 100 passes. The end of the passage 432 is the ejection port 433 from which the printing medium 100 is ejected. The curing heater 41 is located at a position over the passage 432 so as to oppose the upper surface of the printing medium 100 passing through the passage 432, on which ink has been applied. The curing heater 41 heats and cure the ink by irradiating the ink on the printing medium 100 with infrared radiation. Thus, the ink is fixed to the printing medium 100 tightly.

As shown in FIG. 2, the curing heater 41 includes a tube 411 extending in the y direction, and a heating element 412 passing through the tube 411. The tube 411 is made of a metal, and is preferably made of iron. The length, in the y direction, of the tube 411 is preferably larger than the width of the printing medium 100 in the y direction so that the entirety of the ink on the printing medium 100 transferring under the tube 411 (curing heater 41) can be irradiated with infrared radiation.

The heating element 412, which generates heat by receiving electric power, is made of, for example, an electrically-heated wire such as nichrome wire. The tube 411 is heated by heat generated by the heating element 412, thus emitting infrared radiation. Thus, the curable component of the ink is cured. Consequently, the resulting printed article, including the printing medium 100 and the cured ink on the printing medium 100, can exhibit good weather fastness and rub fastness.

The surface temperature of the printing medium 100 being heated is for example in the range of 60 to 120° C., preferably 80 to 100° C. The surface temperature of the printing medium 100 can be measured with, for example, an infrared (IR) sensor. For controlling the surface temperature of the printing medium 100 in these ranges, the power of the curing heater 41 may be switched according to the result of the measurement of the IR sensor.

The cooling fan 42 is disposed downstream of the curing heater 41 in the transfer direction. The cooling fan 42 blows on the printing medium 100 heated with the curing heater 41 to cool the printing medium 100. As with the blowing fan 27 and the suction fan 28, the cooling fan 42 can be selected from among various type of fan without particular limitation, and, for example, may be a multiblade fan.

The support surface 81 of the platen 8 has a plurality of suction holes 82, as described above. Also, the support surface 81 is divided into first portions 811 and second portions 812, as shown in FIG. 3. The first portions 811 are strip-shaped portions in plan view corresponding to the extension lines 75 extending in the transfer direction from the portions between each driven roller 72. The second portions 812 are portions of the support surface 81 other than the first portions 811. The second portions 812 each have larger width than the first portion 811. The suction holes 82 are arranged at different densities between the first portions 811 and the second portions 812. More specifically, each first portion 811 has suction holes 82 with a high density to define a high-density region 83, and each second portion 812 has suction holes 82 with a low density to define a low-density region 84. The high density regions 83 are divided into first high-density regions 831 and second high-density regions 832, as will be described later.

In the high-density regions 83, as shown in FIG. 3, the suction holes 82 are aligned in a line in the transfer direction, or the positive x direction, at some (2 to 5 in the embodiment shown in FIG. 3) intervals. The intervals between the suction holes 82 may be the same or different. The suction holes 82 located most upstream in the transfer direction (hereinafter referred to as most upstream suction hole(s) 82*a*) are arranged in the high-density regions 83. Although the most upstream suction holes 82*a* may be arranged one for each high-density region 83, it is preferable that the most upstream suction holes 82*a* be alternately arranged in the y direction in the high-density regions 83.

The low-density regions 84 each have a small number of suction holes 82, more specifically, at most one suction hole 82. In the low-density regions 84 having one suction hole 82, the suction hole 82 is located at the same position in the x direction of the low-density regions 84. Each of the suction holes 82 in the low-density regions 84 is disposed at a position staggered in the x direction with respect to the positions of the suction holes 82 in the high-density region 83, that is, at a different position in the x direction from the suction holes 82 in the high-density region 83.

Preferably, the density of the arrangement of the suction holes 82 in each high-density region 83 is 1.1 to 10 times, preferably twice to 5 times, as high as that in the low-density region 84. The support surface 81 has a portion that will be overlaid with the head unit 5 (liquid ejection head 23) being transferred by the head moving device 22. This portion is a printing region 85 where the transferring head unit 5 (liquid ejection head 23) prints on the printing medium 100. The printing region 85 is across the high-density regions 83 and the low-density regions 84 in the y direction.

The printing medium 100 on the platen 8 is headed with the drying heater 26, as described above. At this time, the printing medium 100 is expanded by heat (thermal expansion). The driven rollers 72 of the roller unit 74 are arranged immediately upstream of the platen 8. The thermally expanded portion of the printing medium 100 is not pressed by the driven rollers 72. Therefore this thermally expanded portion is likely to be bent and trapped between the driven rollers 72. This printing medium 100 is kept bent (the bent state of the printing medium 100 is referred to as a crease) even on the first portions 811.

However, the suction holes 82 arranged in the first portions 811, which are the high-density region 83 having more suction holes 82 than the second portions 812, preferentially suck creases, thus eliminating the creases. Creases are formed in the thermally expanded portion of the printing medium 100, as described above. This portion is prevented from creasing in the high-density regions 83, and is stretched from the high-density regions 83 in directions of arrows p shown in FIG. 3, and preferentially in the low-density regions 84.

In the printing apparatus 1, the function of the high-density regions 83 to remove creases and the function of the low-density regions 84 to expand portions likely to crease produce a synergistic effect of flattening the printing medium 100 on the printing region 85, as shown in FIGS. 6A and 6B. Consequently, unclear printing resulting from thermal expansion of the printing medium 100 can be certainly prevented.

The high density regions 83 are divided into first high-density regions 831 and second high-density regions 832, as shown in FIG. 3. The first high-density regions 831 lie corresponding to the extension lines 76 extending in the transfer direction from the portions between the holders 73 when viewed from above. The second high-density regions 832 are high-density regions 83 other than the first high-density regions 831. The density of the suction holes 82 in the first high-density regions 831 is higher than that in the second high-density regions. In the embodiment shown in FIG. 3, each first high-density region 831 has five suction holes 82, and the second high-density region 832 has two to four suction holes 82.

The printing medium 100 is more likely to crease in the portions corresponding to the extension lines 76 extending in the transfer direction from the portions between the holders 73 among the first portions 811. However, in the portions of the first portions 811 more likely to cause creases, which are the first high-density regions 831, creases are preferentially sucked, thus more certainly being eliminated.

The printing region 85 of the support surface 81 has more suction holes 82 with a higher density than the other region, or non-printing region 86, downstream of the printing region 85 in the transfer direction. Hence, the density of the suction holes 82 in the support surface 81 is reduced in the transfer direction. The printing medium 100 is certainly stabilized by the suction of the suction holes 82 in the printing region 85. Consequently, the printing apparatus can perform accurate printing on the printing medium 100 on the printing region 85.

The printing medium 100 is thermally expanded from the portion adjacent to the printing region 85 in the direction indicated by arrows q shown in FIG. 3, preferentially in the non-printing region 86. Consequently, the portion to be printed of the printing medium 100 is flattened so that creases are removed as shown in FIGS. 5A and 5B, and thus the unclear printing on the printing medium 100 can be certainly prevented. Preferably, the suction holes 82 have an average diameter of 4 mm or less, more preferably 2 to 4 mm.

The total suction power of the suction holes 82 to suck the printing medium 100 depends on the size of the printing medium 100, particularly on the width in the y direction of the printing medium 100, and preferably, the number of the suction holes 82 and the width of the printing medium 100 satisfy the relationship as shown FIG. 4. By satisfying such a relationship, the printing medium 100 can be adequately sucked according to the size thereof.

While the invention has been described with reference to exemplary embodiments, it is to be understood that the invention is not limited to the disclosed embodiments, and that the components of the printing apparatus of the invention, at least in part, may be replaced with equivalents having the same function. Any other component may be added. Although the number of the suction holes in the high-density region is 2 to 5 in the above embodiment, it is not limited to these numbers, and may be 6 or more.

The entire disclosure of Japanese Patent Application No. 2012-244363, filed Nov. 6, 2012 is expressly incorporated reference herein.

What is claimed is:

1. A printing apparatus comprising:

a transfer device including a plurality of rollers and configured to transfer a flexible printing medium in a transfer direction, the rollers being arranged in a direction intersecting the transfer direction;

a platen disposed immediately downstream of the transfer device in the transfer direction, the platen including a plate having a support surface that supports thereon the printing medium transferred by the transfer device and includes first portions extending in the transfer direction corresponding to extension lines extending in the transfer direction from the portions between each of the rollers and second portions other than the first portions, the second portions corresponding to a width of the rollers, the platen having a plurality of suction holes that are open at the support surface so as to suck the printing medium on the support surface, the suction holes being arranged such that the first portions have suction holes with a higher density than the second portions;

a head unit including a liquid ejection head that prints on the printing medium by ejecting an ink onto the printing medium on the support surface; and a heating device that heats the printing medium on which the ink has been ejected.

2. The printing apparatus according to claim 1, wherein the printing medium will be thermally expanded preferentially at the second portions when heated by the heating device.

3. The printing apparatus according to claim 1, wherein each first portion has two or more of the suction holes, aligned in a line in the transfer direction.

4. The printing apparatus according to claim 1, wherein each second portion has at most one of the suction holes.

5. The printing apparatus according to claim 1, wherein the first portions have the suction holes located most upstream in the transfer direction.

6. The printing apparatus according to claim 1, wherein the transfer device includes a plurality of holders arranged in a direction intersecting the transfer direction, each holder holding at least two of the rollers, and wherein one or more of the first portions lie corresponding to any of the extension lines extending in the transfer direction from the portions between each of the holders, and have suction holes with a higher density than the other first portions.

7. The printing apparatus according to claim 1, further comprising a head moving device that transfers the head unit in a direction intersecting the transfer direction, wherein the support surface has a printing region across the first portions and the second portions, over which the head unit prints while being transferred by the head moving device, and wherein the suction holes are arranged such that the printing region has suction holes with a higher density than a region of the support surface downstream of the printing region in the transfer direction.

8. The printing apparatus according to claim 7, wherein the density of the suction holes is reduced in the transfer direction.

9. The printing apparatus according to claim 1, wherein the density of the suction holes in each first portion is 1.1 to 10 time as high as the density of the suction holes in each second portion.

10. The printing apparatus according to claim 1, wherein the suction holes are circular in shape when viewed from above and have an average diameter of 4 mm or less.

11. The printing apparatus according to claim 1, wherein the transfer device further includes a driving roller that rotates the plurality of the rollers and transfers the printing medium while pinching the printing medium with the plurality of rollers therebetween.

12. The printing apparatus according to claim 1, wherein the heating device includes a heater opposing the support surface with the liquid ejection head therebetween.

13. A printing apparatus comprising:

a head unit that ejects an ink onto a printing medium;

a platen having a support surface that supports the printing medium thereon, the support surface having a plurality of suction holes that suck the printing medium supported on the support surface; and a plurality of rollers that transfer the printing medium in the transfer direction;

wherein the support surface includes first portions extending in the transfer direction corresponding to extension lines extending in the transfer direction from the portions between each of the rollers and second portions other than the first portions, the second portions corresponding to a width of the rollers, and wherein each of the first portions has suction holes with a higher density than each of the second portions.

* * * * *